United States Patent [19]

Kalogeros

[11] Patent Number: 4,743,164

[45] Date of Patent: May 10, 1988

[54] INTERBLADE SEAL FOR TURBOMACHINE ROTOR

[75] Inventor: Robert R. Kalogeros, Glastonbury, Conn.

[73] Assignee: United Technologies Corporation, Hartford, Conn.

[21] Appl. No.: 947,295

[22] Filed: Dec. 29, 1986

[51] Int. Cl.[4] ..... F01D 5/30

[52] U.S. Cl. ..... 416/193 A; 416/221; 416/500

[58] Field of Search ..... 416/193 A, 219 R, 220 R, 416/221, 500

[56] References Cited

U.S. PATENT DOCUMENTS

| | | | |
|---|---|---|---|
| 3,112,915 | 12/1963 | Morris | 416/220 X |
| 3,119,595 | 1/1964 | Wilson et al. | 416/220 |
| 3,266,771 | 8/1966 | Morley | 416/193 A X |
| 3,709,631 | 1/1973 | Karstensen et al. | 416/193 A X |
| 3,887,298 | 6/1975 | Hess et al. | 416/220 |
| 3,972,645 | 8/1976 | Kasprow | 416/215 |
| 4,029,436 | 6/1977 | Shoup et al. | 416/193 A |
| 4,101,245 | 7/1978 | Hess et al. | 416/190 |
| 4,177,013 | 12/1979 | Patterson et al. | 416/193 A |
| 4,183,720 | 1/1980 | Brantley | 416/193 A |
| 4,326,835 | 4/1982 | Wertz | 416/193 A |
| 4,422,827 | 12/1983 | Buxe et al. | 416/193 A |
| 4,455,122 | 6/1984 | Schwarzmann et al. | 416/193 A X |
| 4,457,668 | 7/1984 | Hallinger | 416/193 A X |
| 4,494,909 | 1/1985 | Forestier | 416/193 A X |
| 4,505,642 | 3/1985 | Hill | 416/193 A |
| 4,516,910 | 5/1985 | Bouiller et al. | 416/193 A X |

FOREIGN PATENT DOCUMENTS

| | | | |
|---|---|---|---|
| 62558 | 10/1982 | European Pat. Off. | 416/193 A |
| 1185415 | 1/1965 | Fed. Rep. of Germany | 416/193 A |
| 1300346 | 7/1969 | Fed. Rep. of Germany | 416/193 A |
| 2658345 | 6/1978 | Fed. Rep. of Germany | 416/193 A |
| 836371 | 6/1981 | U.S.S.R. | 416/193 A |

*Primary Examiner*—Everette A. Powell, Jr.
*Attorney, Agent, or Firm*—Troxell K. Snyder

[57] ABSTRACT

A sheet metal seal (42) provides both radial and axial sealing of the gap (34) formed between adjacent blade platforms (30, 32) in a rotor assembly (10) of a turbomachine.

5 Claims, 2 Drawing Sheets

INTERBLADE SEAL FOR TURBOMACHINE ROTOR

FIELD OF THE INVENTION

The present invention relates to a seal disposed between adjacent blades in a rotor of a turbomachine or the like.

BACKGROUND

Axial flow turbomachines, such as a gas turbine engine, include rotors having a plurality of individual blades distributed about the periphery for interacting with an annularly flowing stream of working fluid. It is well known to provide seals along the axially-running gap formed between adjacent blade platforms in such rotor assemblies to prevent the occurrence of radially inward flow of such working fluid. Such interblade seals may be disposed between the rotor disk rim and the underside of the blade platforms within a cavity formed between adjacent blades. This cavity, termed the "damper cavity" is typically adapted to receive an inertial vibration damper for reducing unwanted rotor rim vibration. Such seals may be formed of thin sheet metal as disclosed in U.S. Pat. No. 4,505,642 by Hill, or other flexible construction as in U.S. Pat. No. 4,183,720 by Brantley.

A combination seal and vibration damper is shown in U.S. Pat. No. 4,101,245 by Hess et al. U.S. Pat. No. 4,457,668 by Hallinger shows a trough-shaped damper which channels a radially outward flowing stream of cooling air into an axial passage for cooling engine structure adjacent the opposite face of the rotor assembly.

Seals thus known in the prior art are well suited for preventing radial inflow of the working fluid past the blade platforms and into the damper cavity. Since the typical working fluid in a turbine section of a gas turbine engine consists of pressurized, high temperature combustion products, and since the damper cavity adjoins that portion of the rotating turbine disk which is under the highest material stress, the benefits of such sealing are also well known and continue to inspire designers to seek more effective, inexpensive, and easier to assemble sealing arrangements.

In addition to a radial pressure differential across the blade platform which attempts to induce the working fluid to flow radially between adjacent turbine blades toward the center line of the turbomachine, there is also typically an axial pressure gradient resulting from the successive compression or expansion of the annularly flowing working fluid. This axial pressure gradient also attempts to force working fluid into the damper cavity at the higher pressure face of the rotor assembly, bypassing the rotor blades and, for a turbine rotor assembly in a gas turbine engine, potentially overheating and inducing premature degradation of the turbine disk rim.

Interblade seals of the prior art, designed primarily to seal against radial flow of the working fluid, are not well adapted for preventing axial flow thereof. For example, the combined damper and seal of Hess et al extends between front and rear annular rotor disk sideplates which provide the desirable axial barrier against flow into the damper cavity. The combined structure of the Hess seal-damper is structurally stronger and heavier than the sheet metal and ribbon seals of Hill and Brantley, respectively, thus achieving good axial sealing force against the sideplates at the expense of reduced conformability of the combined member against the underside of the blade platforms.

Conversely, the thin and flexible seals of Hill and Brantley are easily conformed by the centrifugal acceleration induced by the rotation of the rotor assembly, but do not provide sufficient axial rigidity to engage the rotor sideplates to provide an effective, positive axial seal. The Hallinger seal-damper, rather than attempting to thwart axial gas flow, is configured to assist and direct axially flowing cooling air through the corresponding damper cavity.

What is needed is a sealing means which combines both axial and radial sealing ability in a lightweight, conformable seal member.

DISCLOSURE OF THE INVENTION

It is therefore an object of the present invention to provide a means for sealing the gap formed by the platforms of two adjacent blades in an axial flow turbomachine rotor assembly.

It is further an object of the present invention to provide a single sealing means for preventing both axial and radial flow of the turbomachine working fluid from the working fluid flow annulus into a damper cavity disposed radially inward of the blade platforms and circumferentially intermediate adjacent blades.

It is further an object of the present invention to cooperatively shape the radially outward boundary of the damper cavity and the sealing means to increase the sealing force therebetween during operation of the turbomachine.

It is further an object of the present invention to provide a simple sheet metal seal, independent of any inertial blade damper disposed within the damper cavity, for conforming closely to the radially outward boundary of the cavity.

It is further an object of the present invention to provide a sheet metal seal having axially extending front and rear ends for engaging annular corresponding front and rear rotor faceplates for cooperatively establishing a gas tight barrier against the turbomachine working fluid.

It is still further an object of the present invention to provide circumferentially facing positioning slots within the damper cavity adjacent the radially outer boundary for receiving corresponding circumferentially extending arms integral with the sheet metal seal for holding the seal within the damper cavity during assembly of the turbomachine rotor.

According to the present invention, a sheet metal seal is provided within a damper cavity formed radially inward and intermediate the blade platforms of two adjacent blades secured to the periphery of a disk in a rotor assembly. The blade platforms extend circumferentially, terminating at a narrow gap which is spanned within the damper cavity by the sheet metal seal.

The radially inward surface of the adjacent blade platforms forms, in cooperation with the sheet metal seal, an annular gas-tight boundary against the flow of the typically pressurized turbomachine working fluid into the intermediate damper cavity. The cavity outer boundary is shaped in axial cross section to utilize the centrifugal acceleration induced by the rotation of the rotor to provide a sealing force over the entire length of the platform gap.

More particularly, the cavity outer boundary, in axial cross section, defines a radially inward facing concave surface wherein the axial displacement between the axially opposed sides of the boundary increase with decreasing radius. This increasing separation induces a normal force component against the sheet metal sealing member, urging it against the correspondingly shaped platform underside and achieving an axial sealing effect which is not present in prior art sheet metal seals.

Cooperative engagement with the front and rear annular rotor sideplates is enhanced by orienting the sheet metal seal ends in the axial direction adjacent the front and rear ends thereof, thereby providing a close fit with the radially extending sealing surfaces of the rotor assembly sideplates.

Still another feature of the seal according to the present invention are integral, circumferentially extending arms which are received within corresponding, circumferentially opening slots defined within the adjacent blades for positioning and holding the sheet metal seal during assembly of the rotor assembly.

Both these and other features and objects of the seal according to the present invention will be apparent to those skilled in the art upon review of the following description and the appended claims and drawing figures.

DETAILED DESCRIPTION OF THE PREFERRED EMBODIMENT

Figure 1:
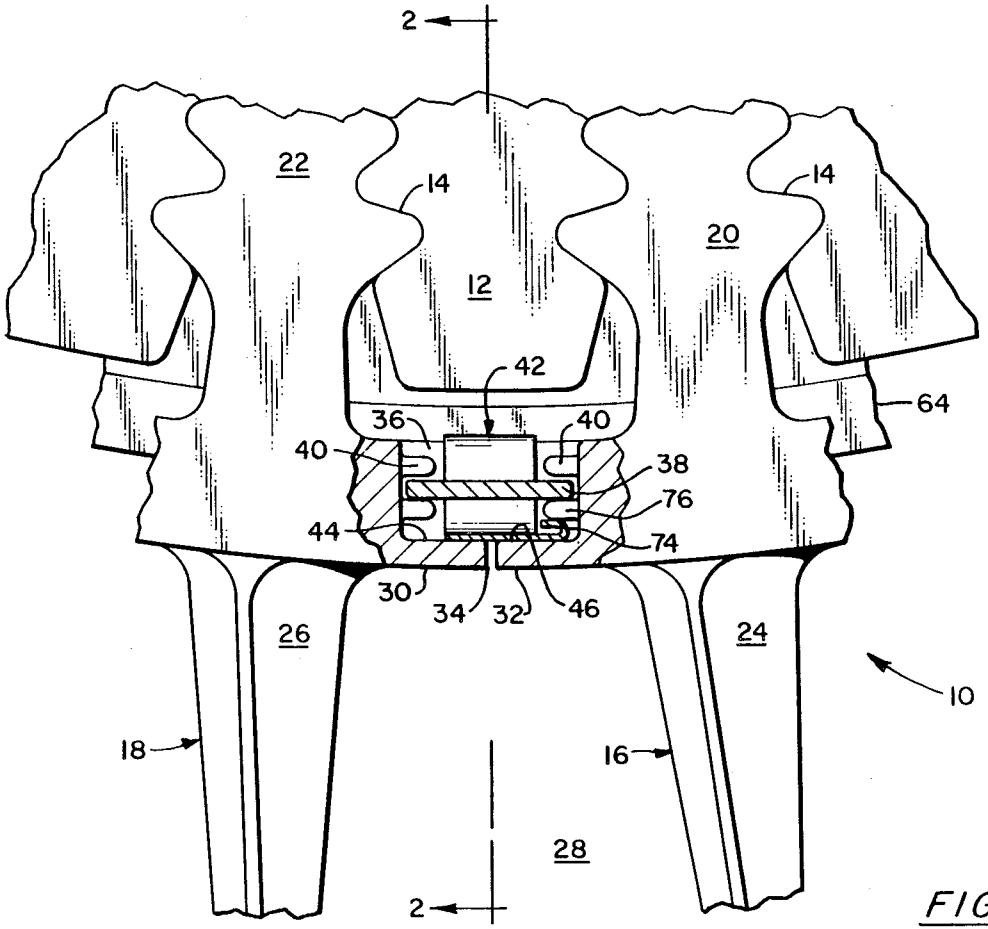
FIG. 1 shows a radial cross section of the periphery of a rotor disk showing a pair of adjacent blades and the intermediate damper cavity defined thereby.

FIG. 1 shows a cross section taken perpendicular to the central axis of a gas turbine engine rotor assembly 10. The rotor assembly 10 includes a disk 12 having a plurality of axially extending slots 14 disposed in the outer periphery for receiving a plurality of individual rotor blades 16, 18.

The rotor blades 16, 18 include root portions 20, 22 which are received within the slots 14 in the disk periphery, airfoil sections 24, 26 which extend radially across the working fluid flow annulus 28, and intermediate platform sections 30, 32 which extend circumferentially and axially to form, in part, an inner annular wall of the flow annulus 28.

The platforms 30, 32 of adjacent rotor blades 16, 18 fit closely to define a substantially axially extending gap 34 therebetween. Also defined radially inward of the blade platforms 30, 32 and intermediate the adjacent blades 16, 18 is a damper cavity 36 typically adapted for receiving an inertial vibration damper 38 positioned by integral lugs 40 extending circumferentially from the blades 16, 18.

As discussed hereinabove, the working fluid flowing in the annulus 28, for the turbine sections of a gas turbine engine, typically consists of hot combustion products which must be isolated from the rim periphery to avoid overheating this highly stressed component. As both the radial and axial pressure distribution of the working fluid over the rotor assembly 10 is such that flow into the damper cavity 36 is encouraged, the axial and radial sealing between the adjacent rotor blades 16, 18 is especially critical in reducing engine service frequency and maintenance time. Reduced leakage between successive turbine stages also results in higher engine efficiency and improved overall performance.

According to the present invention, a sheet metal seal 42 is configured to fit closely against the undersides 44, 46 of the corresponding blade platforms 30, 32. The seal 42 extends axially between the front and rear faces of the rotor disk 12 and circumferentially across the gap 34 formed by the platforms 30, 32.

Figure 2:
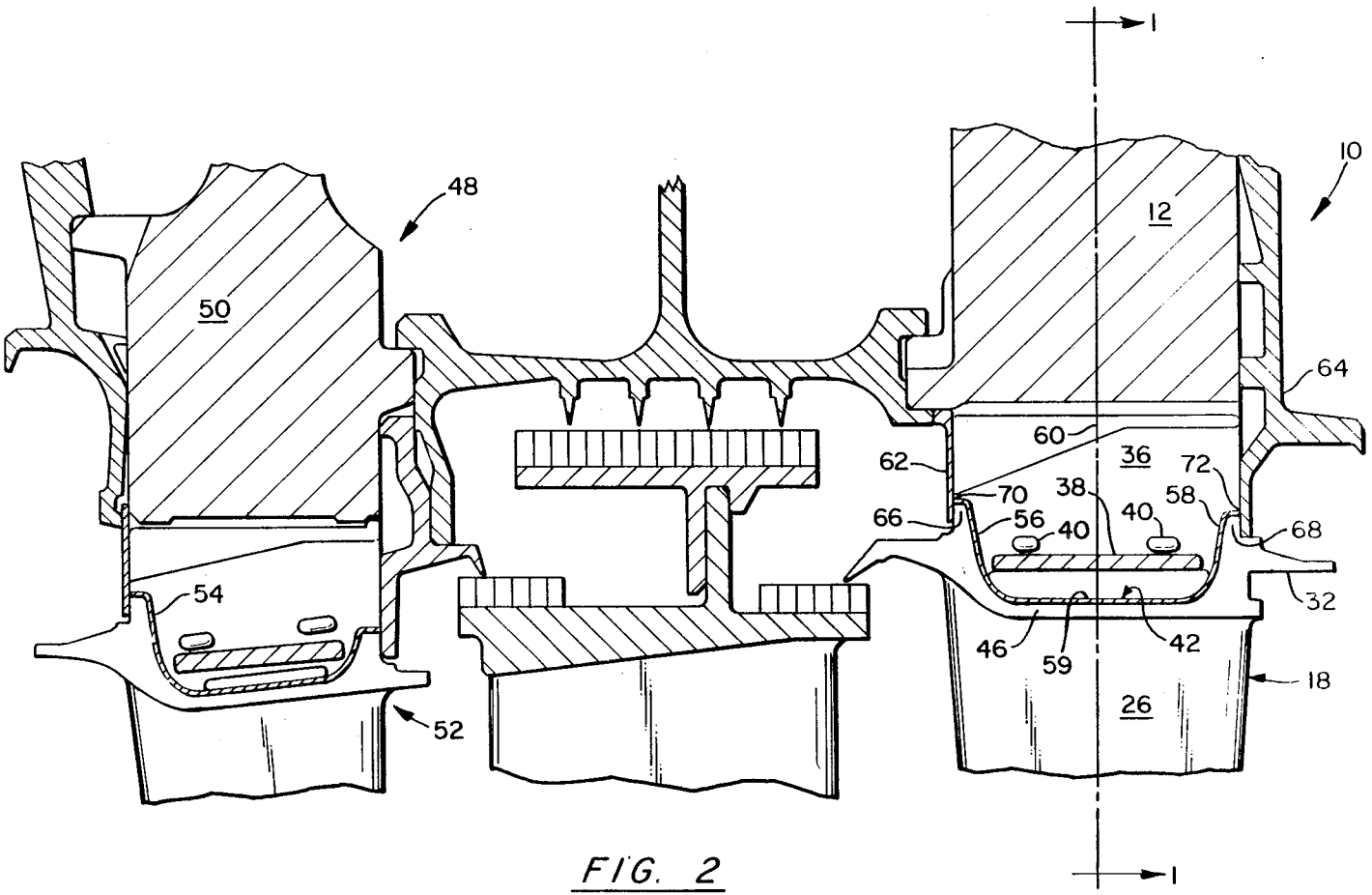
FIG. 2 shows an axial cross section of the damper cavity and rotor disk as indicated in FIG. 1.

FIG. 2 shows an axial cross section of the disk 12 as shown in FIG. 1 in addition to the axially adjacent rotor assembly 48 comprised of disk 50, blades 52, and sheet metal seals 54. The rotor assembly 10 as shown in FIG. 2 shows the sheet metal seal 42 closely fitting against the underside 46 of the corresponding blade platform 32 thus forming a gas tight radially outer boundary of the damper cavity 36. The underside 46 and seal 42 define a radially inward opening concave shape when viewed in axial cross section as in FIG. 2, with the axial dimension thereof increasing with decreasing radius.

It will be appreciated by those skilled in the art that the seal 42 and correspondingly shaped platform undersides 44, 46 cooperate to achieve gas tight sealing therebetween in both the radial and axial direction during high speed rotation of the rotor assembly 10. The radially outward acceleration induced by the rotation of the assembly 10 forces the sheet metal seal 42 tightly against the platform undersides 44, 46, conforming the seal 42 thereagainst and establishing a barrier against the higher pressure working fluid.

FIG. 2 also shows the axial sealing feature of the seal 42 according to the present invention. Both the seal 42 and the platform undersides 44, 46 include axially spaced apart sloping portions 56, 58, and a central portion 59 oriented substantially transverse to the rotor radius 60. Together, the sloping portions 56, 58 and the central portion 59 form the radially inward opening concave outer cavity boundary as discussed hereinabove.

Due to the sloping seal portions 56, 58, the outward force induced by the assembly rotation is resolved into a normally directed component which urges the sloping portions 56, 58 against the corresponding platform surfaces. Although the degree of slope required to achieve the desired sealing force may vary between different rotor assemblies due to the differential pressure of the working fluid, radius of the seal 42, angular speed of the rotor assembly 10, etc., an angle of 15° between the sloping seal portions 56, 58 and the disk radius 60 has been found to be an effective design parameter for typical gas turbine applications.

FIG. 2 also shows another feature of the seal 42 according to the present invention which enhances sealing between the front and rear rotor disk sideplates 62, 64. The annular sideplates 62, 64 engage corresponding radially inward extending land portions 66, 68 for axially retaining the blade 18 within the corresponding disk slot 14. The land portions 66, 68 and the corresponding seal end portions 56, 58 are configured to extend axially for bringing the front and rear tips 70, 72 of the sheet metal seal 42 into perpendicular contact with the corresponding annular rotor faceplates 62, 64. This perpendicular end orientation allows the sheet metal seal 42 to be closely fit between the sideplates 62, 64, thereby providing an effective and simple sealing interface.

One final feature of the sealing means according to the present invention is shown in FIG. 1 wherein a circumferentially extending arm 74 is shown trapped within a corresponding, circumferentially extending lug 76 for positioning and holding the sheet metal seal 42 during assembly of the rotor disk 12 and blades 16, 18. The seal 42 is pressed into the groove defined by the lug 76 and the underside 46 of the corresponding blade platform 32, compressing the curved arm 74 and retaining the seal 42 in the appropriate position as the blades 18, 16 are slid axially into the disk 12.

The seal 42 according to the present invention thus provides a lightweight, easily assembled, and effective sealing barrier against both axial and radial flow of the working fluid into the damper cavity 36. It will further be appreciated that although disclosed and described in terms of the illustrated preferred embodiment, other configurations and arrangements thereof may be made without departing from the scope of the invention as claimed hereinafter.

I claim:

1. A means for sealing a damper cavity formed between first and second adjacent rotor blades secured to the periphery of a turbomachine rotor assembly turning about an axis of rotation, each rotor blade including a radially inward root portion for engaging a rotor disk, a radially outward airfoil portion for operatively contacting an annular, axially flowing stream of a working fluid, a radially intermediate platform portion extending axially beyond the rotor disk on each side thereof and circumferentially toward a corresponding platform extending from a next adjacent blade for forming an axially extending gap therebetween, the blade platform portions further configured to define, in cooperation with the rotor and the adjacent blade root portions, said damper cavity radially inward thereof, said damper cavity extending the axial depth of the rotor disk and including, in axial cross section, a generally concave radially outward boundary defined by the undersides of the adjacent blade platforms, and wherein the sealing means comprises:

a sheet metal seal, disposed within said damper cavity and fitting closely against the radially outward boundary thereof, the seal extending circumferentially across the gaps and overlapping the adjacent blade platform undersides, and the seal and platform further shaped to define a concave radially outward cavity boundary wherein the interior axial cavity dimension increases with inward radial displacement.

2. The sealing means as recited in claim 1, wherein the cavity radially outward boundary includes an axially centrally disposed portion lying substantially in a plane transverse to the rotor radius, and front and rear end portions, extending radially inward and axially apart from the central portion, each front and rear portion describing an angle of approximately 15° with respect to the rotor radius.

3. The sealing means as recited in claim 1, further comprising:

an inertial vibration damper received within the damper cavity and distinct from the sheet metal seal.

4. In a sheet metal seal for forming a gas tight boundary between a pressurized, annularly flowing working fluid in an axial turbomachine and a damper cavity disposed between a pair of circumferentially adjacent blades in a rotor assembly in said axial turbomachine, the improvement comprising:

a generally concave radially outward boundary of the damper cavity, the axial interior dimension of the outer boundary increasing with decreasing radius, and the sheet metal seal extending fully axially over the cavity outward boundary and closely fitting thereagainst, whereby the sheet metal seal is urged radially outwardly and axially against the cavity boundary by centrifugal acceleration induced by rotation of the rotor assembly.

5. The sheet metal seal as recited in claim 4, wherein the improvement further comprises a circumferentially extending arm, integral with the sheet metal seal, the arm being received within a corresponding circumferentially extending groove disposed in one of the adjacent blades for retaining the sheet metal seal adjacent the platform underside of the one blade, at least during initial engagement of the one blade and the disk.

* * * * *